US007064626B2

(12) United States Patent
Kukita et al.

(10) Patent No.: US 7,064,626 B2
(45) Date of Patent: Jun. 20, 2006

(54) ELECTRICAL CONNECTOR

(75) Inventors: Hiroaki Kukita, Yokohama (JP); Hirofumi Yamagata, Yokohama (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/093,147

(22) Filed: Mar. 7, 2002

(65) Prior Publication Data

US 2002/0182937 A1 Dec. 5, 2002

(30) Foreign Application Priority Data

Mar. 28, 2001 (JP) ..... 2001-092178

(51) Int. Cl.
*H01P 1/00* (2006.01)
*H01R 33/00* (2006.01)

(52) U.S. Cl. ..... 333/24 C; 333/260; 439/660

(58) Field of Classification Search ..... 439/608, 439/660; 333/24 C, 260
See application file for complete search history.

(56) References Cited

U.S. PATENT DOCUMENTS

| | | | | |
|---|---|---|---|---|
| 5,073,761 | A | 12/1991 | Waterman et al. | 333/24 C |
| 5,105,201 | A | 4/1992 | Nakase et al. | 343/715 |
| 5,432,486 | A | 7/1995 | Wong | 333/109 |
| 5,936,841 | A | 8/1999 | Kantner et al. | 361/737 |
| 6,206,875 | B1 | 3/2001 | Long et al. | 606/41 |

FOREIGN PATENT DOCUMENTS

| | | |
|---|---|---|
| JP | 2-224401 | 9/1990 |
| JP | 2-235417 | 9/1990 |
| JP | 3-41601 | 2/1991 |
| JP | 6-29047 | 4/1994 |
| JP | 7-115304 | 5/1995 |
| JP | 10-233266 | 9/1998 |
| JP | 11-86980 | 3/1999 |

OTHER PUBLICATIONS

European Search Report dated Apr. 7, 2004, 3 pages.
Japanese Office Action dated Jun. 29, 2004 with translation (4 pages).

*Primary Examiner*—Dean Takaoka
(74) *Attorney, Agent, or Firm*—Osha Liang LLP

(57) ABSTRACT

A board-to-board electrical connector is so constructed that when connectors 2 and 3 are fitted to each other, capacitive coupling plates 24 and 34 are brought into the state in which they partly confront each other, with a space between each other, and also a coupling capacitance between the capacitive coupling plates 24 and 34 is adjusted by adjusting an area formed by partly confronting portions of the capacitive coupling plates 24 and 34 and a distance between the partly confronting portions of the capacitive coupling plates 24 and 34. With this construction, the board-to-board electrical connector having a specified band-pass characteristic is achieved.

5 Claims, 5 Drawing Sheets

ELECTRICAL CONNECTOR

BACKGROUND OF THE INVENTION

The present invention relates to an electrical connector for interconnecting two boards or equivalent.

A variety of board-to-board electrical connectors to electrically interconnect two boards or equivalent have been developed.

In general, the board-to-board electrical connector has a pair of male and female connectors each having one or more contacts. When the pair of male and female connectors are fitted to each other, their contacts are brought into physical contact with each other and thereby the two boards or equivalent are electrically connected. Thus, the contacts of the pair of male and female connectors of the board-to-board electrical connector are brought into physical contact with each other, for the reason of which this type of board-to-board electrical connector does not have the band-pass characteristic that only a signal within a specified frequency band transmits from one of the pair of connectors to the other.

Thus, in this general type of board-to-board electrical connector, a noise-cut filter is additionally required for cutting noise transmitted from one connector to the other. Also, for allowing only a signal within a specified frequency band to transmit from the one connector to the other, an additional band-pass filter having the corresponding band-pass characteristic is required.

It is the object of the present invention to provide a board-to-board electrical connector having a band-pass characteristic.

BRIEF SUMMARY OF THE INVENTION

A board-to-board electrical connector of the present invention comprises a first connector having a first conductor; and a second connector having a second conductor which is brought into the state in which at least a part thereof confronts a part of the first conductor with space there between, when the second connector is fitted to the first connector, wherein capacitance between the first conductor and the second conductor is adjusted so that only a signal within a specified frequency band can be allowed to pass between the first conductor and the second conductor.

According to the board-to-board electrical connector thus constructed, when the first connector and the second connector are fitted to each other, the first conductor and the second conductor are brought into the state in which they partly confront each other, with space between each other, and also the capacitance between the first conductor and the second conductor is adjusted so that only a signal within a specified frequency band can be allowed to pass between the first conductor and the second conductor, whereby the board-to-board electrical connector having the specified band-pass characteristic is achieved. In addition, when the first connector and the second connector are fitted to each other, the first and second conductors are in a spaced non-contacting relation, whereby increase in impedance, which is caused by the conductors being contacted with each other as in the conventional contact type, is prevented. As a result of this, deterioration of the band-pass characteristic of the board-to-board electrical connector is prevented.

In the board-to-board electrical connector mentioned above, the capacitance between the first conductor and the second conductor is adjusted by adjusting permittivity between the first conductor and the second conductor, a distance between confronting portions of the first and second conductors, or an area formed by the confronting portions of the first and second conductors.

According to the board-to-board electrical connector thus constructed, the capacitance between the first conductor and the second conductor can be easily adjusted to a specified value, and as such can provide the board-to-board electrical connector having a specified band-pass characteristic with ease.

In the board-to-board electrical connector mentioned above, a plurality of conductor plates provided in at least either of the first connector and the second connector confront each other; the first connector is provided with one or more first conductors which are located between the plurality of conductor plates of each pair when the first connector and the second connector are fitted to each other; and the second connector is provided with one or more second conductors which are located between the plurality of conductor plates of each pair and also are brought into capacitive coupling with the first conductor when the first connector and the second connector are fitted to each other.

According to the board-to-board electrical connector thus constructed, since the conductor plates are located between the plurality of signal lines of each pair which are formed by the first conductors and the second conductors corresponding thereto, the signals transmitting through the respective signal lines can be prevented from interfering with each other. In addition, when the capacitances between the first conductors and the second conductors corresponding thereto of each pair are adjusted to values different from each other, the board-to-board electrical connector having different band-pass characteristics can be achieved.

BRIEF DESCRIPTION OF THE INVENTION

Figure 1:
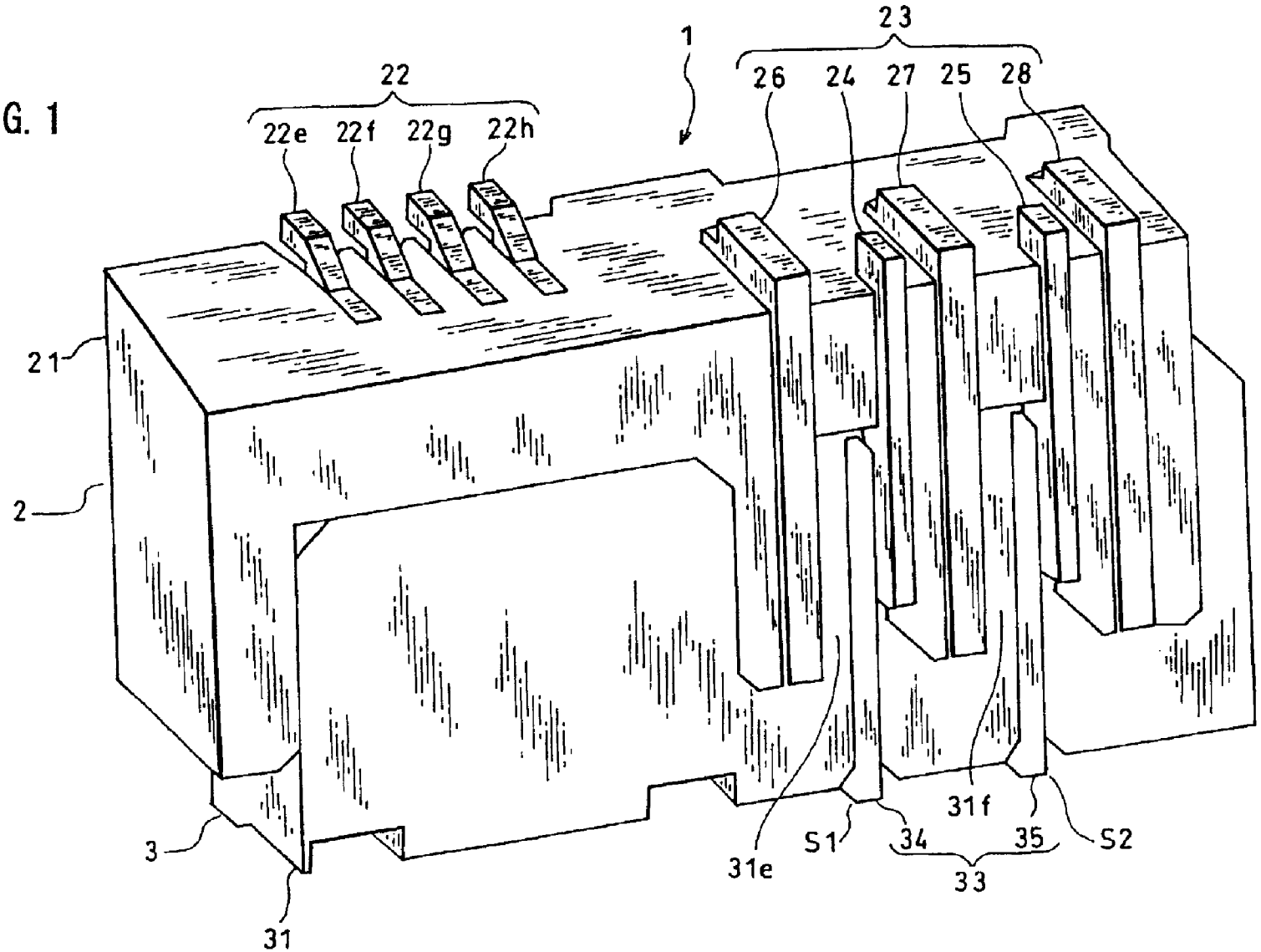
FIG. 1 is a perspective view in section of a board-to-board electrical connector of the invention.
Figure 4:
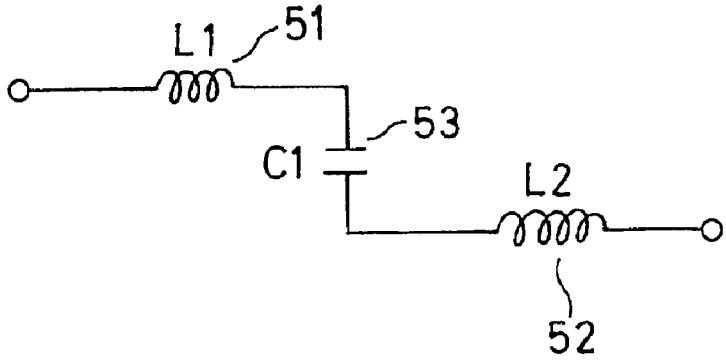
FIG. 4 is a diagram showing the equivalent circuit relating to the capacitive coupling plates comprised in the board-to-board electrical connector whose perspective view in section is shown in FIG. 1.
Figure 7:
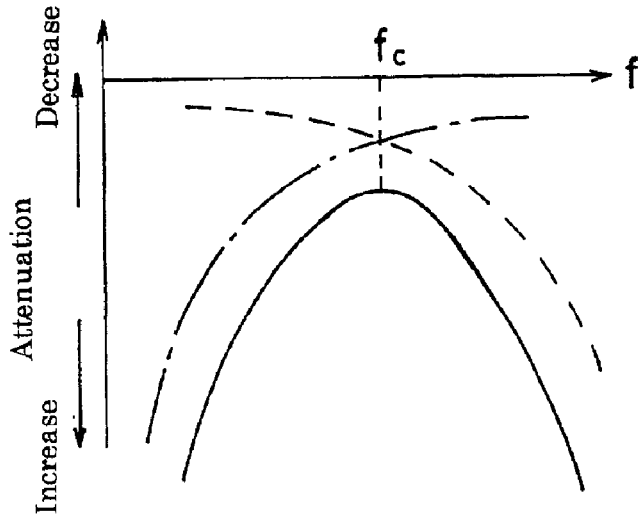
Figure 8:
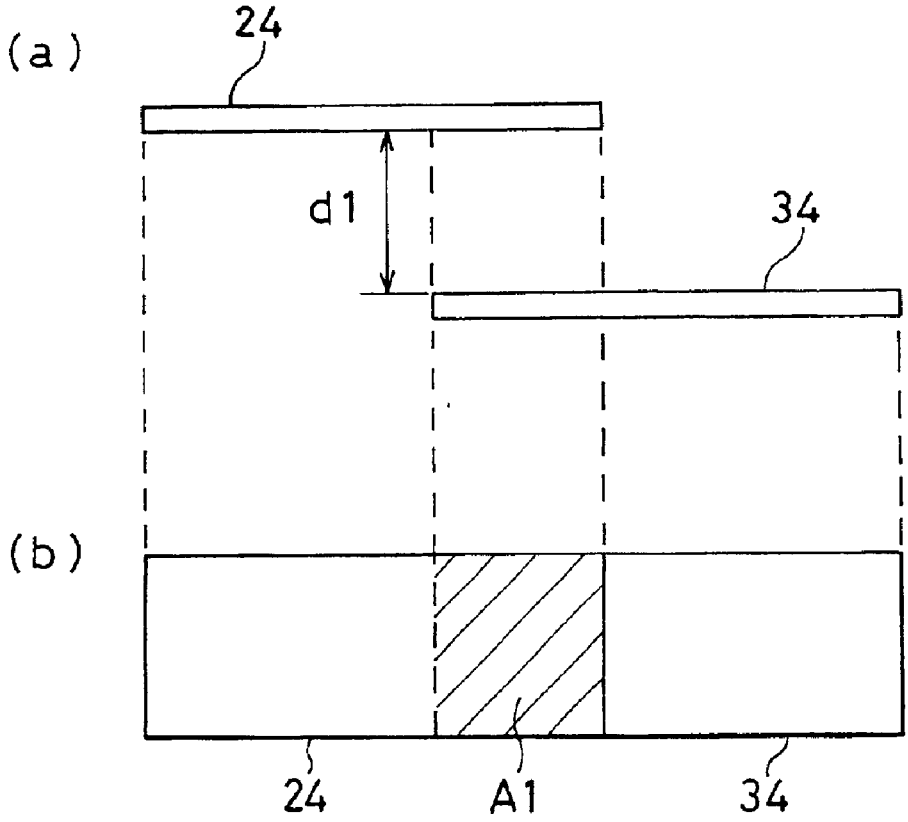

FIG. 7 is a diagram for illustrating an outline of the frequency characteristic of the equivalent circuit shown in FIG. 4; and FIG. 8 is a diagram for illustrating the area formed by confronting portions of the opposed capacitive coupling plates comprised in the board-to-board electrical connector whose perspective view in section is shown in FIG. 1 and the distance between the confronting portions of the capacitive coupling plates.

DETAILED DESCRIPTION OF THE PREFERRED EMBODIMENTS

In the following, a certain preferred embodiment of the present invention will be described with reference to the accompanying drawings.

Figure 2:
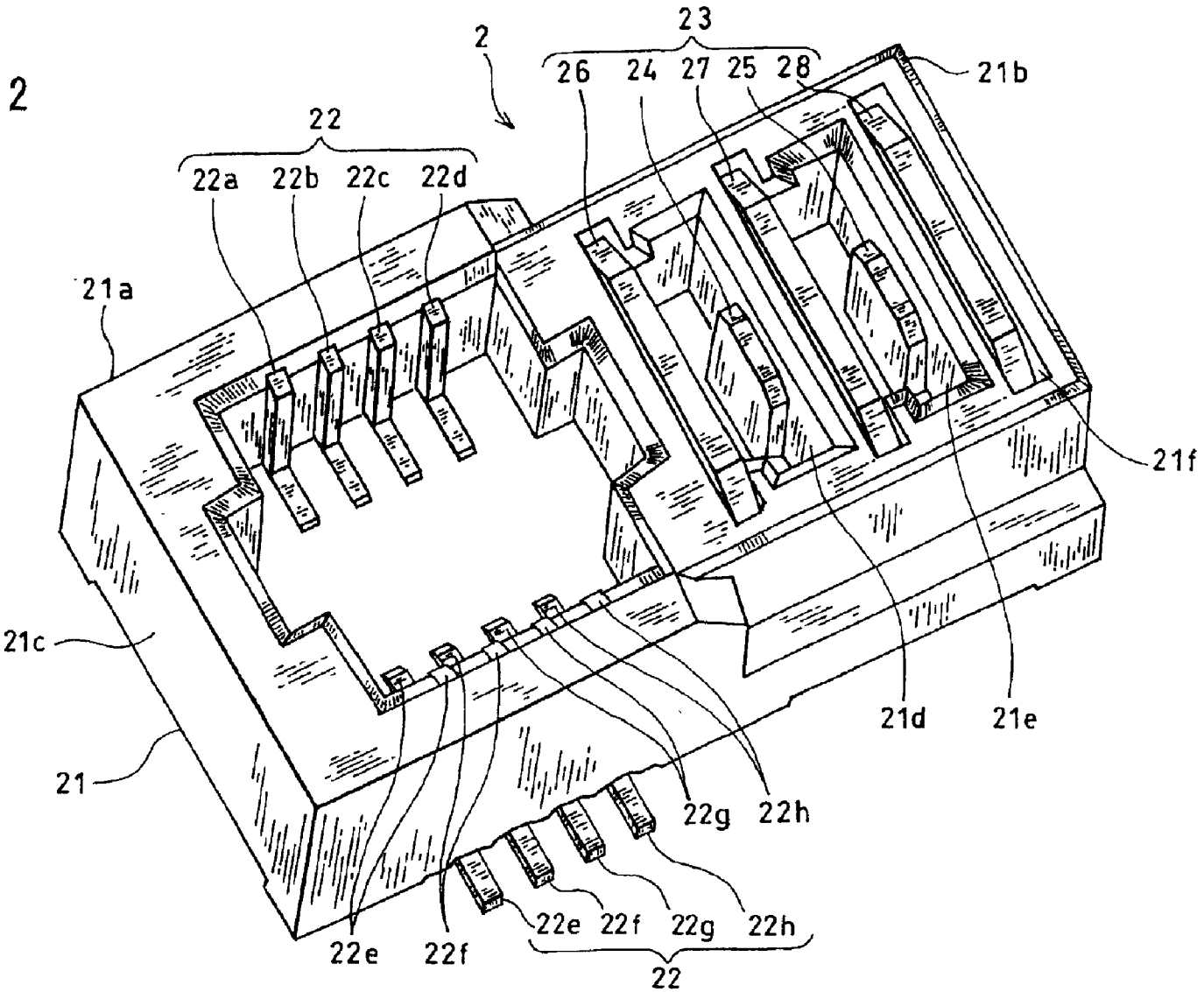
FIG. 2 is a perspective view of one connector of the board-to-board electrical connector whose perspective view in section is shown in FIG. 1.
Figure 3:
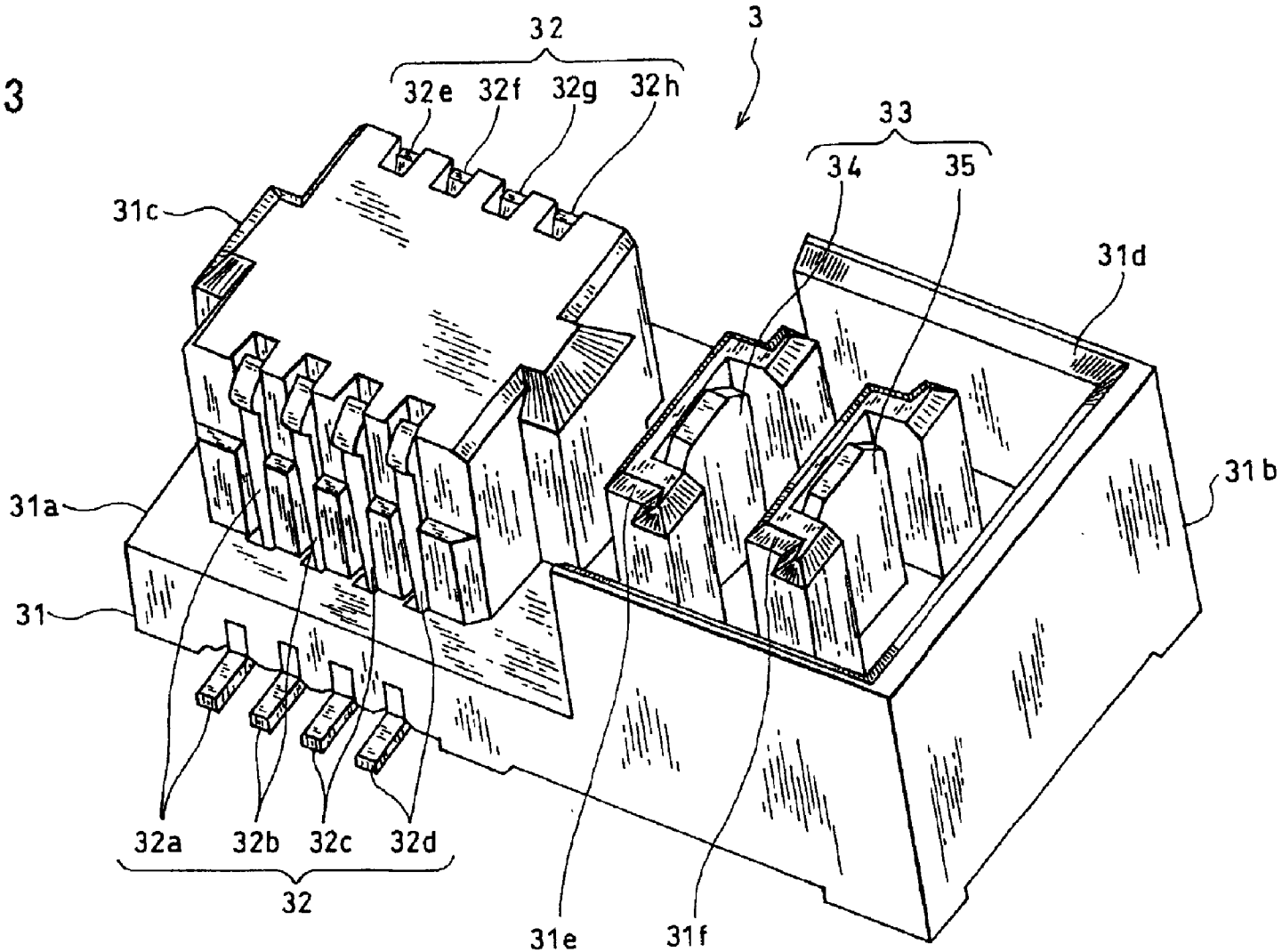
FIG. 3 is a perspective view of the other connector of the board-to-board electrical connector whose perspective view in section is shown in FIG. 1.

A board-to-board electrical connector 1 comprising a pair of male and female connectors shown in FIGS. 1–3 includes a connector 2 and a connector 3.

The connector 2 comprises a housing 21, a group of terminals 22 mainly used for slow signals held in the housing 21, and a group of terminals 23 mainly used for fast signals held in the housing 21, as shown in FIG. 2.

The housing 21 is formed in one piece which comprises a terminal-group holding portion 21*a* for holding the group of terminals 22 and a terminal-group holding portion 21*b* for holding the group of terminals 23. The terminal-group holding portion 21*a* has a concave portion 21*c*. On the other hand, the terminal-group holding portion 21*b* has three concave portions 21*d*, 21*e* and 21*f*.

The group of terminals 22 comprises a total of eight contacts 22*a*, 22*b*, 22*c*, 22*d*, 22*e*, 22*f*, 22*g* and 22*h* which are identical in shape and are aligned in two columns and four rows. These contacts are accommodated in the concave portion 21*c* of the terminal-group holding portion 21*a* of the housing 21.

The group of terminals 23 is held in the terminal-group holding portion 21*b* of the housing 21 and comprises two capacitive coupling plates 24 and 25 and three conductor plates 26, 27 and 28.

The capacitive coupling plate 24, which is a conductor having a flat-plate form, is held in the housing 21 so as to be accommodated in the concave portion 21*d* of the terminal-group holding portion 21*b*. When the connector 2 and the connector 3 are fitted to each other, the capacitive coupling plate 24 comes into the state in which it partly confronts a part of a capacitive coupling plate 34 of the connector 3 mentioned later, with spaced therefrom.

The capacitive coupling plate 25, which is a conductor having a flat-plate form, is held in the housing 21 so as to be accommodated in the concave portion 21*e* of the terminal-group holding portion 21*b* and so as to be parallel with the capacitive coupling plate 24. When the connector 2 and the connector 3 are fitted to each other, the capacitive coupling plate 25 comes into the state in which it partly confronts a part of a capacitive coupling plate 35 of the connector 3 mentioned later, with spaced therefrom.

As shown in FIG. 1. in cooperation with the capacitive coupling plate 34 of the connector 3 mentioned later which comes into a position of spaced relation with the capacitive coupling plate 24 when the connectors 2 and 3 are fitted to each other, the capacitive coupling plate 24 forms a signal line S1 for being transmitted signals from a printed circuit board (not shown) mounting the connector 2 thereon to a printed circuit board (not shown) mounting the connector 3 thereon or vice versa. Also, in cooperation with the capacitive coupling plate 35 of the connector 3 mentioned later which comes into non-contact with partly confrontation with the capacitive coupling plate 25 when the connectors 2 and 3 are fitted to each other, the capacitive coupling plate 25 forms a signal line S2 for being transmitting signals from the printed circuit board (not shown) mounting the connector 2 thereon to the printed circuit board (not shown) mounting the connector 3 thereon or vice versa.

Each of the conductor plates 26, 27 and 28 has a flat-plate form. The conductor plate 26 is held in the housing 21 so as to be accommodated in the concave portion 21*d* of the terminal-group holding portion 21*b* and so as to be parallel with the capacitive coupling plate 24. The conductor plate 27 is held in the housing 21 so as to be accommodated in the concave portion 21*e* of the terminal-group holding portion 21*b* and so as to be parallel with the capacitive coupling plate 25. Further, the conductor plate 28 is held in the housing 21 so as to be accommodated in the concave portion 21*f* of the terminal-group holding portion 21*c* and so as to be parallel with the conductor plates 26 and 27.

The connector 3 comprises a housing 31, a group of terminals 32 mainly used for slow signals held in the housing 31, and a group of terminals 33 mainly used for fast signals held in the housing 31, as shown in FIG. 3.

The housing 31 is formed in one piece which comprises a terminal-group holding portion 31*a* for holding the group of terminals 32 and a terminal-group holding portion 31*b* for holding the group of terminals 33. The terminal-group holding portion 31*a* has a convex portion 31*c*. On the other hand, the terminal-group holding portion 31*b* has a "U-shaped" frame portion 31*d* and includes projecting portions 31*e* and 31*f*.

The group of terminals 32 comprises a total of eight contacts 32*a*, 32*b*, 32*c*, 32*d*, 32*e*, 32*f*, 32*g* and 32*h* which are identical in shape and are aligned in two columns and four rows. These contacts are held in side walls of the convex portion 31*c* of the terminal-group holding portion 31*a* of the housing 31.

The group of terminals 33 is held in the terminal-group holding portion 31*b* of the housing 31 and comprises two capacitive coupling plates 34 and 35.

The capacitive coupling plate 34 is a conductor having a flat-plate form. The capacitive coupling plate 34 is held in the housing 31 so as to be located between the projecting portions 31*e* and 31*f* provided in the terminal-group holding portion 31*b*. The capacitive coupling plate 34 is held in the housing 31 so that when the connector 2 and the connector 3 are fitted to each other, it can be parallel with the conductor plate 26 of the connector 2 and also can confront a part of the capacitive coupling plate 24, with spaced therefrom.

The capacitive coupling plate 35 is a conductor having a flat-plate form. The capacitive coupling plate 35 is held in the housing 31 so as to be located at the opposite side to the projecting portion 31*e* with respect to the projecting portion 31*f* provided in the terminal-group holding portion 31*b*. The capacitive coupling plate 35 is held in the housing 31 so that when the connector 2 and the connector 3 are fitted to each other, it can be parallel with the conductor plate 27 of the connector 2 and also can confront a part of the capacitive coupling plate 25, with spaced therefrom.

In the following, the fitting of the connectors 2 and 3 will be described.

When the convex portion 31*c* provided in the housing 31 of the connector 3 is accommodated in the concave portion 21*c* provided in the housing 21 of the connector 2, the group of terminals 22 of the connector 2 and the group of terminals 32 of the connector 3 are brought into contact with each other.

Also, the terminal-group holding portion 21*b* of the connector 2 is accommodated in the frame portion 31*d* of the terminal-group holding portion 31*b* of the connector 3. Then, the projecting portion 31*e* provided in the housing 31 of the connector 3 and the capacitive coupling plate 34 of the connector are accommodated in the concave portion 21*d* provided in the terminal-group holding portion 21*b* of the connector 2 so as to be located between the conductor plate 26 and capacitive coupling plate 24 of the connector 2. Then, the capacitive coupling plate 24 and the capacitive coupling plate 34 partly confront each other in the non-contact state. Also, the projecting portion 31*f* provided in the housing 31 of the connector 3 and the capacitive coupling plate 35 of the connector 3 are accommodated in the concave portion 21*e* provided in the terminal-group holding portion 21*b* of the connector 2 so as to be located between the conductor plate 27 and capacitive coupling plate 25 of the connector 2. Then, the capacitive coupling plate 25 and the capacitive coupling plate 35 partly confront each other in the non-contact state.

In the following, the band-pass characteristic of the board-to-board electrical connector of the present invention will be described.

When the connector 2 and the connector 3 are fitted to each other, since the capacitive coupling plate 24 and the capacitive coupling plate 34 partly confront each other in the non-contact state, and there is presented a capacitance between the capacitive coupling plates 24 and 34 that depends on the area formed by confronting portions of the capacitive coupling plates 24 and 34 and on the distance between the confronting portions of the capacitive coupling plates 24 and 34. Also, there is presented an inductance in each of the capacitive coupling plates 24 and 34.

It follows from this that an equivalent circuit relating to the capacitive coupling plate 24 and the capacitive coupling plate 34 is given as shown in FIG. 4. In FIG. 4, an inductor 51 corresponds to the inductance of the capacitive coupling plate 24, and the inductance of the inductor 51 is represented here as L1. An inductor 52 corresponds to the inductance of the capacitive coupling plate 34, and the inductance of the inductor 52 is represented here as L2. A capacitor 53 corresponds to the capacitance between the capacitive coupling plate 24 and the capacitive coupling plate 34, and the capacitance of the capacitor 53 is represented here as C1.

The concepts underlying a band-pass characteristic of the equivalent circuit shown in FIG. 4 is discussed here.

Figure 5:
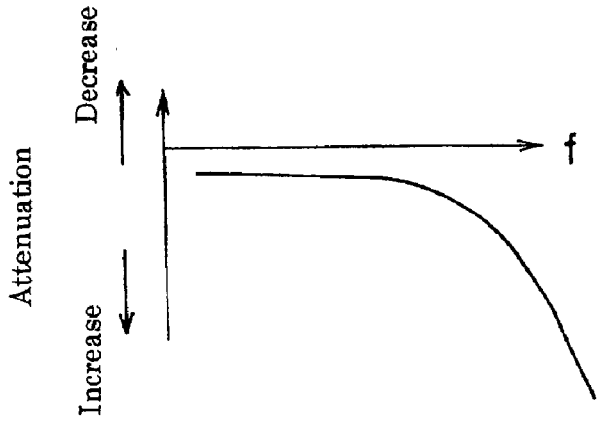
FIG. 5 is a diagram for giving an outline of frequency characteristic of an inductor.
Figure 6:
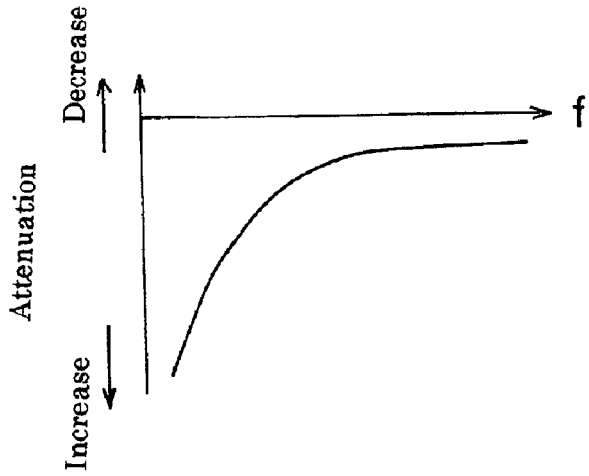
FIG. 6 is a diagram for giving an outline of frequency characteristic of a capacitor.

In general, the inductors 51 and 52 have a frequency characteristic that attenuation increases with increase in frequency f, as schematically shown in FIG. 5. On the other hand, the capacitor 53 has a frequency characteristic that attenuation decreases with increase in frequency f, as schematically shown in FIG. 6. Therefore, an outline of attenuation of the equivalent circuit shown in FIG. 4 is given by the sum of the attenuation by the capacitor 53 and the attenuation by the inductors 51 and 52, as is represented in full line in FIG. 7. Therefore, the equivalent circuit relating to the capacitive coupling plates 24 and 34 has a band-pass characteristic. It is to be noted that a dotted line in FIG. 7 represents the sum of the attenuation by the inductor 51 and the attenuation by the inductor 52 and a dashed line in FIG. 7 represents the attenuation by the capacitor 53.

A further discussion on the band-pass characteristic of the equivalent circuit is given below.

An impedance Z of the circuit as viewed from the signal insertion side is expressed as the following equation (1)

$$Z = R + j\left\{2\times\pi\times f\times(L1+L2) - \frac{1}{2\times\pi\times f\times C1}\right\} \quad \text{Eq. (1)}$$

where R represents components of resistance on the signal receiving side.

If the 2nd term of the right side of the equation (1) is 0, a load of the impedance Z becomes minimum and the attenuation of the equivalent circuit becomes minimum. Where the frequency at this time is represented as fc, the frequency fc is derived as follows.

The 2nd term of the right side of the equation (1) is 0.

$$2\times\pi\times fc\times(L1+L2) - \frac{1}{2\times\pi\times f\times C1} = 0 \quad \text{Eq. (2)}$$

The equation (2) is changed into the following equation (3).

$$fc = \frac{1}{2\times\pi\times\sqrt{(L1+L2)\times C1}} \quad \text{Eq. (3)}$$

As seen from the equation (3), the value of the frequency fc varies depending on values of the inductances L1 and L2 and a value of the capacitance C1. In other words, the value of the frequency fc at which the attenuation becomes minimum is varied depending on the values of the inductances L1 and L2 and the value of the capacitance C1.

An absolute value of the impedance Z can be given by the following equation (4).

$$|Z| = \sqrt{R^2 + \left\{2\times\pi\times f\times(L1+L2) - \frac{1}{2\times\pi\times f\times C1}\right\}^2} \quad \text{Eq. (4)}$$

As seen from the equation (4), even when the value of the frequency f is identical, the absolute value of the impedance Z varies depending on the values of the inductances L1 and L2 and the value of the capacitance C1. In other words, even when the value of the frequency f is identical, the attenuation of the equivalent circuit varies depending on the values of the inductances L1 and L2 and the value of the capacitance C1. Therefore, the bandwidth for the signals to pass varies depending on the values of the inductances L1 and L2 and the value of the capacitance C1.

It can be seen from foregoing that the band-pass characteristic of the equivalent circuit can vary by being varied the values of the inductances L1 and L2 and the value of the capacitance C1.

Similarly, an equivalent circuit relating to the capacitive coupling plate 25 and the capacitive coupling plate 35 has a band-pass characteristic that is determined by the value of the capacitance and the value of the inductance. As a result of this, only a signal within a specified frequency band can be allowed to pass from the capacitive coupling plate 25 to the capacitive coupling plate 35 or vice versa.

Next, description of the capacitance C1 between the capacitive coupling plate 24 and the capacitive coupling plate 34 is given.

In general, a capacitance C between two flat-plate electrodes is expressed by the following equation (5)

$$C = \varepsilon\frac{S}{d} \quad \text{Eq. (5)}$$

where S is an area of the flat-plate electrodes, d is a distance between the flat-plate electrodes, and $\epsilon$ is the permittivity therebetween.

Therefore, it follows from the equation (5) that the capacitance C1 between the capacitive coupling plates 24 and 34 is given by the following equation (6)

$$C1 = \varepsilon_0 \frac{A1}{d1} \quad \text{Eq. (6)}$$

where A1 is an area formed by confronting portions of the capacitive coupling plates 24 and 34 and d1 is a distance between the confronting portions thereof (a between-opposing-plates distance), as shown in FIG. 8. In the illustrated embodiment, since an air exists in the space between the capacitive coupling plates 24 and 34, the permittivity is $\epsilon_0$.

As seen from the equation (6), the value of the capacitance C1 can be adjusted by properly adjusting the values of the area A1 and the between-opposing-plates distance d1.

Thus, since the band-pass characteristic of the equivalent circuit relating to the capacitive coupling plate 24 and the capacitive coupling plate 34 is determined by the value of the capacitance C1 of the capacitor 53 and the values of the inductances L1 and L2 of the inductors 51 and 52, as mentioned above, if the value of the capacitance C1 of the capacitor 53 is set at a specified value by adjusting the values of the area A1 and the between-opposing-plates distance d1, the equivalent circuit can have a specified band-pass characteristic.

Similarly, the band-pass characteristic of the equivalent circuit relating to the capacitive coupling plate 25 and the capacitive coupling plate 35 can have a specified band-pass characteristic by setting the value of the capacitance at a specified value by adjusting an area formed by confronting portions of the capacitive coupling plates 25 and 35 and a distance between the confronting portions thereof.

Modification may be made in the present invention such that dielectrics are disposed between the capacitive coupling plate 24 and the capacitive coupling plate 34 and between the capacitive coupling plate 25 and the capacitive coupling plate 35, respectively, so that the value of the capacitance can be adjusted by changing the kinds of dielectrics or the permittivity. Also, the value of the capacitance may be adjusted by any selective combination among the kinds of dielectrics (the permittivity), the area formed by confronting portions of the capacitive coupling plates, and the distance between the confronting portions thereof.

According to the embodiment illustrated above, the board-to-board electrical connector having the specified band-pass characteristic can be achieved by adjusting the value of the capacitance between the capacitive coupling plates. As the result of this, a frequency of signals transmitting from one printed circuit board to the other printed circuit board can fall within a specified frequency band without any additional band-pass filter, and also the noise can be cut without any additional band-pass filter.

In addition, the board-to-board electrical connector having different band-pass characteristics can be achieved by setting the area formed by the confronting portions of the capacitive coupling plates 24 and 34 and the distance between the confronting portions thereof, and the area formed by the confronting portions of the capacitive coupling plates 25 and 35 and the distance between the confronting portions thereof at different values.

Also, since the capacitive coupling plate 24 and the capacitive coupling plate 34 are put in non-contact with each other, variation of the band-pass characteristic caused by deterioration of the capacitive coupling plates 24 and 34 can be prevented. Similarly, since the capacitive coupling plate 25 and the capacitive coupling plate 35 are put in non-contact with each other, variation of the band-pass characteristic caused by deterioration of the capacitive coupling plates 25 and 35 can be prevented.

Further, since the conductor plate 27 exists between the signal lines S1 and S2, the signal transmitting through the signal line S1 and the signal transmitting through the signal line S2 can be prevented form interfering with each other.

While the preferred embodiment of the present invention has been illustrated above, it will be understood that the present invention should not be limited to the embodiment illustrated above and various changes and modifications in design may be made in the invention within the scope of the claims. For example, while in the embodiment illustrated above, the two signal lines are formed, any adequate number of signal lines may selectively be formed. While in the embodiment illustrated above, the conductor plates 26, 27 and 28 are comprised in the connector 2, they may alternatively be comprised in the connector 3. In addition, the conductor plates may be comprised in both of the connectors 2 and 3 so that when the connectors 2 and 3 are fitted to each other, the conductor plates comprised in the both connectors respectively can be brought into contact with each other to form a grand plane. Further, a plurality of capacitive coupling plates may be used to form a plurality of signal lines between the conductor plates 26 and 27. Further, it is needless to say that the present invention is applicable to various types of electrical connectors as well as to the board-to-board electrical connector.

What is claimed is:

1. An electrical connector comprising:

a first connector having a first conductor; and a second connector having a second conductor, wherein, when the second connector is fitted to the first connector, while the first conductor and the second conductor are electrically connected, at least a part of the second conductor confronts a part of the first conductor such that a physical space exists between the entire confronting parts of the first conductor and the second conductor, wherein capacitance between the first conductor and the second conductor is adjusted so that only a signal within a specified frequency band can be allowed to pass between the first conductor and the second conductor.

2. The electrical connector according to claim 1, wherein the capacitance between the first conductor and the second conductor is adjusted by adjusting at least one of a permittivity between the first conductor and the second conductor, a distance between confronting portions of the first and second conductors, and an area formed by the confronting portions of the first and second conductors.

3. The electrical connector of claim 1, wherein, the entire confronting parts of the first conductor and the second conductor have a physical spaced relation, and wherein the physical spaced relation comprises an area component and a distance component, the area component being an amount of area of spaced overlap between the at least a part of the first conductor and the at least a part of the second conductor, and the distance component being a distance between the at least a part of the first conductor and the at least a part of the second conductor, wherein at least one of the area component and the distance component are adjustable so as to only allow a signal within a specified frequency band to pass from the first conductor to the second conductor.

4. An electrical connector comprising:

a first connector having a first conductor; and a second connector having a second conductor, wherein, when the second connector is fitted to the first connector, at least a part of the second conductor confronts a part of the first conductor such that a space exists between the first conductor and the second conductor, wherein capacitance between the first conductor and the second conductor is adjusted so that only a signal within a specified frequency band can be allowed to pass between the first conductor and the second conductor, wherein the capacitance between the first conductor and the second conductor is adjusted by adjusting at least one of a permittivity between the first conductor and the second conductor, a distance between confronting portions of the first and second conductors, and an area formed by the confronting portions of the first and second conductors, wherein a conductor plate is provided in at least either of the first connector and the second connector, wherein the first connector is provided with one or more first conductors which face the conductor plate when the first connector and the second connector are fitted to each other, wherein the second connector is provided with one or more second conductors which face the conductor plate and also are brought into capacitive coupling with the first conductor when the first connector and the second connector are fitted to each other, and wherein the one or more pairs of the capacitive coupled first and second conductors are located opposite to each other with respect to the conductor plate.

5. An electrical connector comprising:

a first connector having a first conductor; and a second connector having a second conductor, wherein, when the second connector is fitted to the first connector, at least a part of the second conductor confronts a part of the first conductor such that a space exists between the first conductor and the second conductor, wherein capacitance between the first conductor and the second conductor is adjusted so that only a signal within a specified frequency band can be allowed to pass between the first conductor and the second conductor, wherein a conductor plate is provided in at least either of the first connector and the second connector, wherein the first connector is provided with one or more first conductors which face the conductor plate when the first connector and the second connector are fitted to each other, wherein the second connector is provided with one or more second conductors which face the conductor plate and also are brought into capacitive coupling with the first conductor when the first connector and the second connector are fitted to each other, and wherein the one or more pairs of the capacitive coupled first and second conductors are located opposite to each other with respect to the conductor plate.

* * * * *